US006119440A

United States Patent [19]

Benner, Jr. et al.

[11] Patent Number: 6,119,440

[45] Date of Patent: Sep. 19, 2000

[54] SINGLE LEVEL MULTIPLE PRODUCT FILLER WHEEL

[75] Inventors: Harold Thomas Benner, Jr., Cincinnati, Ohio; Mark R. Nease, Lakeside Park, Ky.

[73] Assignee: R. A. Jones & Co. Inc.

[21] Appl. No.: 09/165,936

[22] Filed: Oct. 2, 1998

[51] Int. Cl.[7] ..... B65B 3/04

[52] U.S. Cl. ..... 53/473; 53/202

[58] Field of Search ..... 53/455, 562, 202, 53/473; 141/145, 144, 104, 105, 100, 310, 314

[56] References Cited

U.S. PATENT DOCUMENTS

| | | | |
|---|---|---|---|
| 3,821,873 | 7/1974 | Benner, Jr. et al. | 53/562 |
| 4,053,003 | 10/1977 | Ferrero et al. | 141/144 |
| 4,232,504 | 11/1980 | Dieterlen et al. | 53/570 |
| 4,344,269 | 8/1982 | Dieterlen et al. | 53/562 |
| 4,892,233 | 1/1990 | Zelickson | 141/144 |
| 5,082,032 | 1/1992 | Crocker | 141/144 |
| 5,320,146 | 6/1994 | Stevie | 141/144 |
| 5,337,795 | 8/1994 | Mihail et al. | 141/144 |
| 5,605,183 | 2/1997 | Hartman et al. | 141/145 |
| 5,645,114 | 7/1997 | Bogen et al. | 141/145 |
| 5,762,116 | 6/1998 | Moore | 141/145 |

*Primary Examiner*—Peter Vo
*Assistant Examiner*—Sam Tawfik
*Attorney, Agent, or Firm*—Wood, Herron & Evans, LLP

[57] ABSTRACT

A single level filler wheel for filling pouches with multiple products including a filler wheel having at least two sets of funnels defined within the wheel and spouts attached to the underside of the wheel, alternating spouts communicating with funnels of each set so that products dispensed on the wheel into two different feed paths are respectively received by the respective funnel sets and transferred directly into alternating spouts for filling at least two products, one into each alternate pouch. The total product drop is halved with respect to dual level filling devices and through-put speeds can be significantly increased. Multiple products in excess of two and varied feed drops can be provided by adding funnel sets, alternating spouts differently and the like. Methods and apparatus are disclosed.

34 Claims, 5 Drawing Sheets

SINGLE LEVEL MULTIPLE PRODUCT FILLER WHEEL

BACKGROUND OF THE INVENTION

This invention relates to pouch filling apparatus and more particularly to apparatus for filling more than one product into alternating pouches of a chain of pouches.

In the past, it is known to support a chain of open-topped pouches about a circular path for filling with a rotating filling wheel. The pouches are formed, for example, from an elongated indeterminate length web with two sides folded together along an elongated fold line. Transverse seams define parallel pouch side edges while a pouch top or mouth is defined between adjacent web edges left unsealed to remain open for filling. Such a pouch train is usually supported in an annular or circular pathway beneath the corresponding filling wheel circumference defined by a series of spouts having discharge ends for fitting into respective pouch mouths and transferring product into the pouches from the spouts. The pouch train is then provided with a top edge seal and the pouches are cut apart, separated or otherwise prepared for packaging. Such apparatus and variations thereof are shown and described in U.S. Pat. Nos. 3,821,873; 4,232,504; 3,908,979; 4,316,566; 4,344,269; 4,702,289; 4,956,964; 5,064,450; 5,220,993; 5,222,422; 5,315,807; 5,320,146; 5,502,951; 5,579,984 and 5,611,194, each of which are expressly incorporated herein by reference.

Product is measured into each pouch by a member of varied, long known methods or apparatus. For example, in one long known method, product is continually fed by a feeder such as a belt or auger. When the feed rate is coordinated with the speed of the feeder, including the speed of the pouch, and with the front to back length of the pouch mouth, the product volume dropped into each spout is accurately repeatable.

In the industry, it is becoming desirable to provide more packaging flexibility for pouching equipment. For example, it is desirable to fill a chain of pouches with two or more different products on an alternating basis. For example, in filling pouches with a powder such as cocoa mix, it may be desirable to fill a first pouch with regular mix, a second pouch with marshmallows or a diet variety of mix, a following pouch with a regular mix, and so on in alternating fashion.

In order to provide a multiple product or multiple flavor fill in alternating pouches, applicant has, in the past, used a dual level filling apparatus. This was comprised of a spout wheel mounting spouts for receiving product and dispensing it into pouches. Above this wheel, a multiple flavor plate was mounted to the machine shaft and was provided with two or more circularly-oriented product receiving channels, each feeding a plurality of sets of separate drop funnels mounted respectively on the bottom side of the flavor plate and at alternating distances from the center of rotation. Differing products are fed into respective channels and dropped through the plate into the depending drop funnels, one product from a first channel into drop funnels on an inner radius, and another product from a second outer channel into the drop funnels on an outer radius. The discharge openings of each of all the drop funnels are disposed over upper ends of the spouts below so that product from one set of funnels is dropped into alternate spouts and another product from the other set of funnels is dropped into the spouts between the alternate spouts for thus filling alternating pouches with different products.

The use of a dual level spout wheel and a plate disposed thereabove with additional funnels, product channels and the like complicates the apparatus. It renders the apparatus more complex and substantially extends the distance and thus the time of the product to drop from the plate into the pouches. This substantially reduces the potential speeds or production rates of the pouch apparatus. For example, in one prior multiple flavor, dual level system of applicant, such system required nineteen inches or more drop from the product channel on the upper plate through the depending funnels, then into the spouts and to the discharge opening of the spouts on the spout wheel. This lengthy drop of frequently very lightweight or light density product significantly reduces the overall filling speeds otherwise available if such a long drop was not required. For example, since each defined volume of product took a certain time to drop, overall speeds available were necessarily a function of this drop time.

Accordingly, it is desirable to provide a multiple product pouch filling apparatus capable of increased through-put speeds with fewer elements or components than multiple product fillers of the past.

To these ends, a preferred embodiment according to the invention includes a single level multiple product filling wheel. The filling wheel comprises a single wheel having a top surface including two or more circular product channels proximate the periphery of the wheel and a series of two or more sets of funnels defined within the wheel, each set corresponding to a particular product and channel. Each funnel defined within the thickness of the wheel has a discharge opening separate and distinct from the discharge opening of all other funnels in the wheel, and there are no depending funnels attached to the underside of the wheel. A plurality of pouch filling spouts is attached directly to an undersurface of the wheel, each spout having a mouth surrounding the discharge opening of a respective funnel, but not of any other funnel. Thus, product in one funnel can be discharged into one spout, and product in another funnel into another spout. The discharge openings of the funnels are on varied radial distances from the wheel center, while the spouts have discharge openings substantially on the same radial distance from the wheel center to align with the open mouths of pouches carried in a circular path therebelow.

Accordingly, the invention includes a single level multiple product filler wheel where product is deposited on the wheel, drops into funnels defined within the wheel's thickness and directly from there into discharge spouts mounted directly on the undersurfaces of the wheel for direct deposit into pouches. The total drop distance from the wheel top to the spout discharge opening is, in one embodiment, about nine to ten inches. Thus, the drop distance is one half or more less than that of the prior device and time required for the product drop is substantially less than that known for prior two level devices. This preferred embodiment can be used in systems running at through rates or production speeds in excess of the prior known multiple product processes of the dual level variety.

In a pouch filling process where numerous operations are required, such as web folding, sealing, filling, top sealing, cutting and the like, any one of the operations used in a continuous motion process can limit the throughput rates of the entire process where the other operations are of faster capacity. The invention thus enables and provides a filling system capable of improved speeds and enabling faster operation that with prior dual-level multiple product filling apparatus where the time required for the drop made the filling process a significant obstacle to the through rate. The prior pouch machines may, through the use of the invention, be increased, for example, from about 900 pouches per minute to about 1100 pouches per minute or more, even where multiple product filling is performed.

These and other objectives and advantages will be readily seen in the following description of a preferred embodiment and from the drawings in which.

Figure 1:
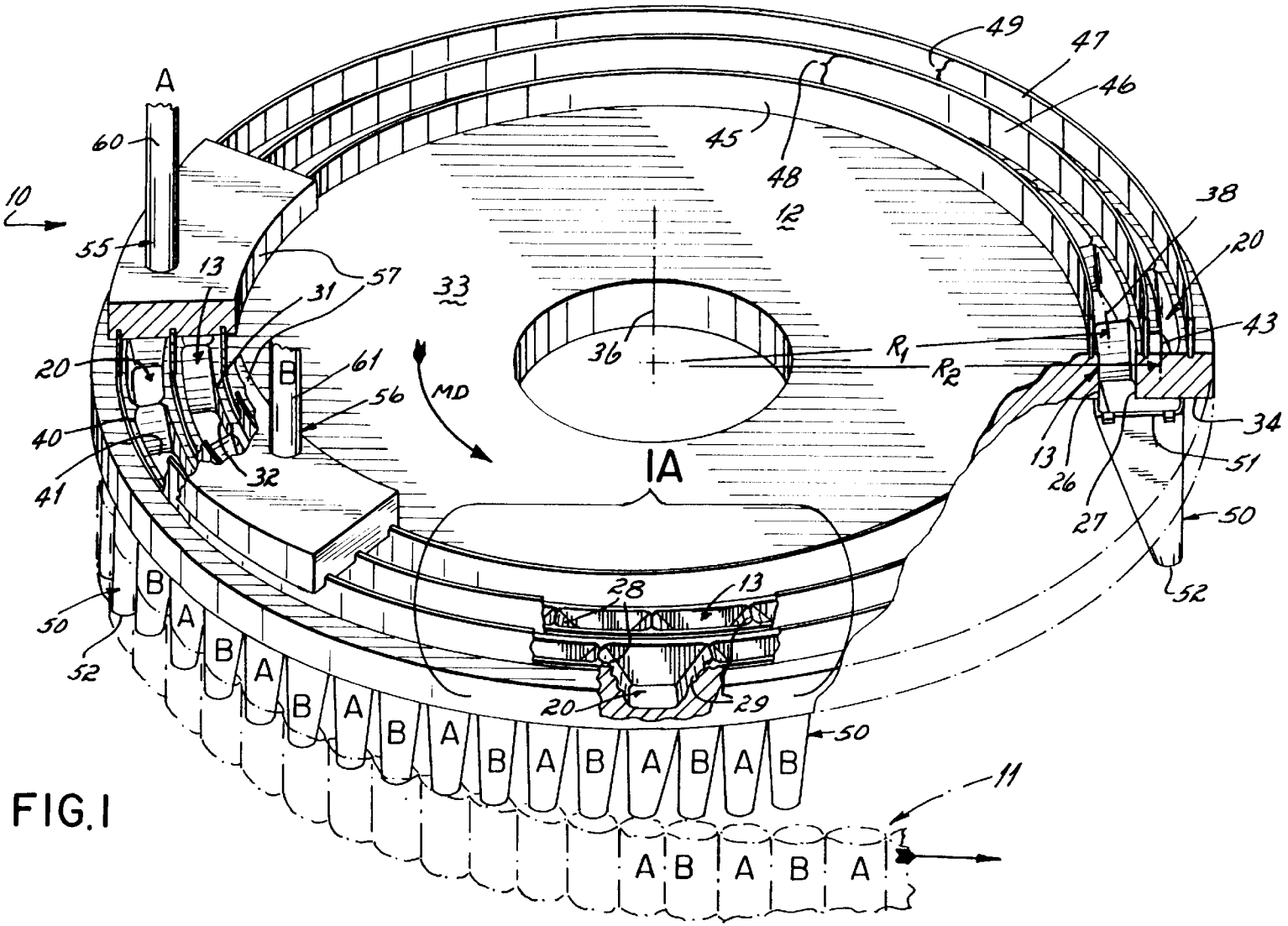
FIG. 1 is a perspective illustration of one embodiment of the invention with a portion cut away for clarity.

Turning now to the drawings, there is shown in FIG. 1 a filler 10 illustrating a preferred embodiment according to the invention. The filler, as shown, is particularly adapted for depositing two different products, such as two different flavors or sugar and sugar-free products, or drink mix and marshmallows, for example, for hot chocolate, to alternating pouches, such as pouches A and pouches B, in a chain of pouches 11. Throughout this description, these letters will be used to denote the items associated with one or the other of the different products handled by this embodiment.

It should be appreciated that the chain of pouches 11 is a typical pouch chain formed of a single web and folded along an elongated center fold to form the bottom of the pouch.

Each pouch is then provided with side seals which are transversed to the now-folded web and seal one side of the web to the other, leaving an open pouch mouth at the top. These pouches have been filled by a plurality of spouts with different products on an alternating basis, so that a first pouch contains one product and an immediately following pouch in the pouch chain 11 contains another product.

As noted, and for the purposes of this description, this particular embodiment illustrates the filling of two different products. It will, of course, be appreciated that the invention is adaptable to three or even more products. Moreover, and by variation of the configuration of the spouts, for example, the products can be deposited in the pouches in many alternative forms, such as the same product being deposited in two pouches with an immediately-following pouch having a second product, and then the immediately-following two pouches having a first product and so on.

Nevertheless, as disclosed in these figures and for purposes of this description, this particular embodiment of the invention is particularly adapted for the feeding of two different products, so that a different product is filled alternately into each of the succeeding pouches. Alternatively, both feeders associated with the invention, as will be described, could be set up to deliver the same product, so that all pouches are filled with the same product without requiring any change in a particular structure of the invention, and resulting in a faster through put as will be described.

Figure 1A:
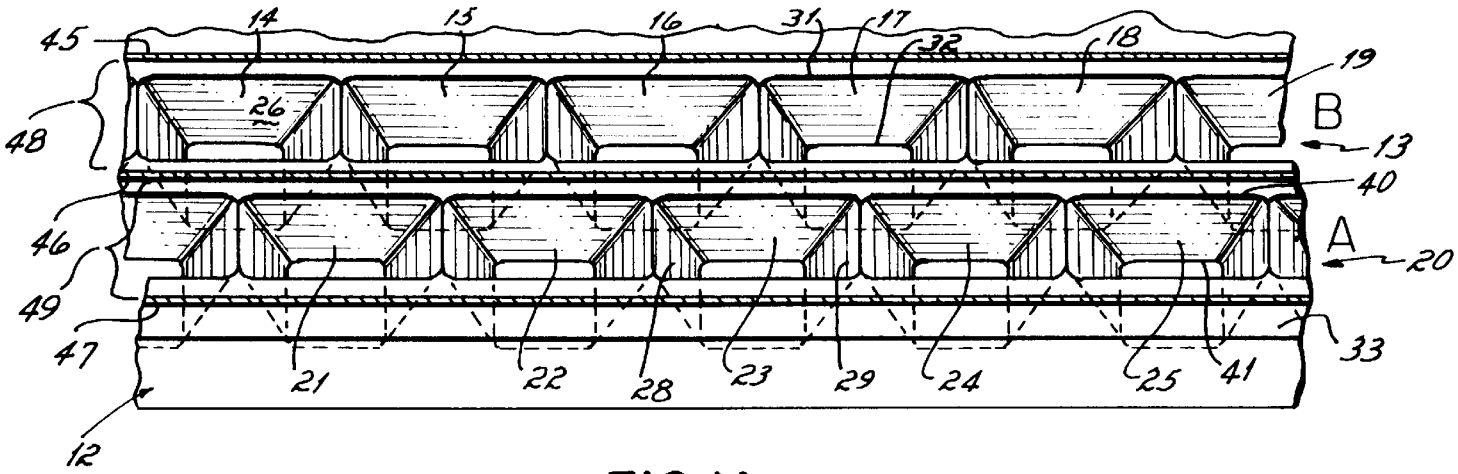
FIG. 1A is a developed view of the encircled portion of FIG. 1 to illustrate the funnels of the invention.
Figure 2:
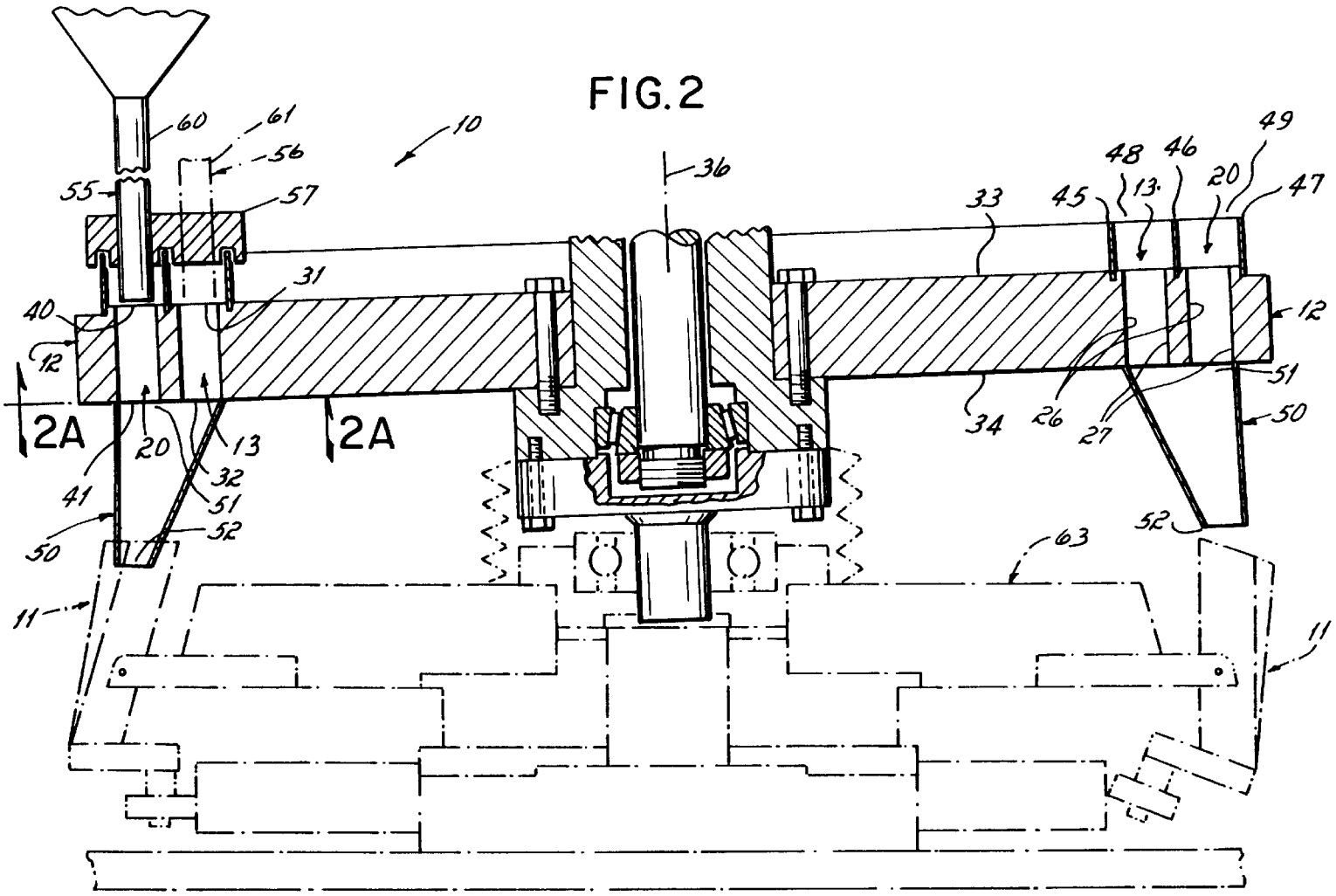
FIG. 2 is a cross-section of the invention, showing the pouch holding mechanisms in phantom.

Referring again to the invention, the invention generally includes a filler wheel 12, shown perhaps best in cross section in FIG. 2. As perhaps best seen in FIG. 1A, the filler wheel 12 has defined within it two different sets, 13 and 20, of funnels. Set 13 includes funnels 14–19 (FIG. 1A), for example, and set 20 includes funnels 21–25 (FIG. 1A). Set 13 will be referred to as a first set of funnels handling material or product associated with the letter "B", and set 20 as a second set of funnels handling material or product associated with the letter "A". If more than two different products were utilized, of course, additional sets of funnels corresponding to the number of different products would be utilized.

Figure 4A:
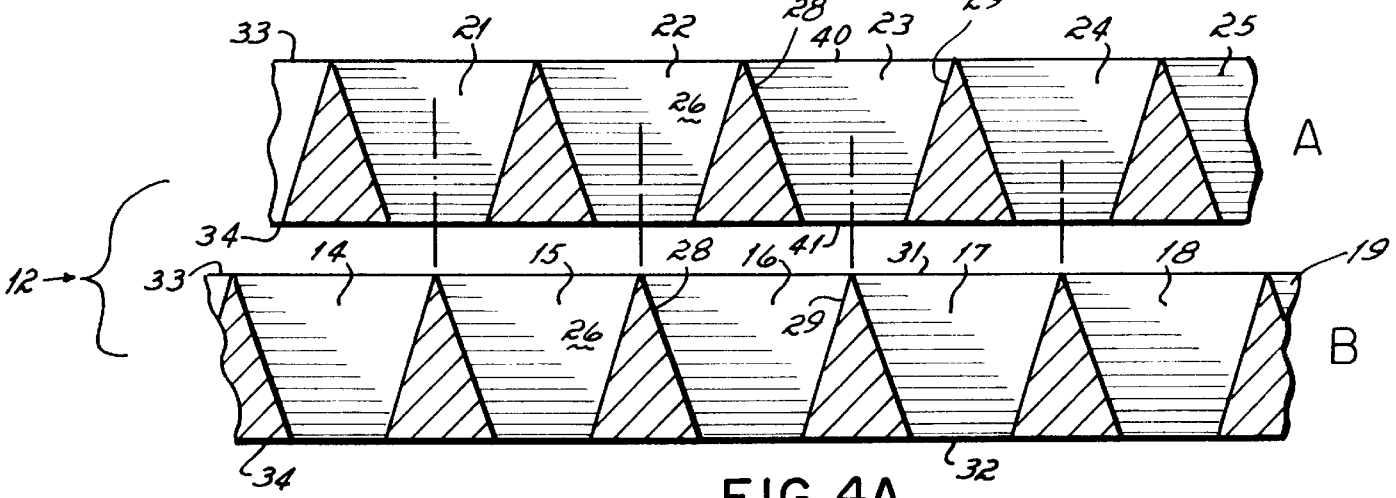
FIG. 4A is a developed view of the invention illustrating the orientation of the funnel sets of the invention, such as shown in FIG. 1A.

It will be appreciated that each set of funnels is formed and defined within the thickness of the wheel 12. As shown, each funnel has relatively straight sides, such as a funnel side 26, 27 as illustrated in FIG. 2. Each of the funnels also has tapered leading and trailing walls, such as trailing wall 28 and leading wall 29 of the funnel 23, as best seen in FIG. 4A.

Each of the funnels in the same set are substantially identical. Thus, all the funnels in set 13 are substantially identical to each other, while the funnels in set 20 are substantially identical to each other as well.

Moreover, while it was noted above that the sides 26 and 27 of the funnels are relatively straight, the funnel sides can be curved or made in an arcuate fashion corresponding to the particular curvature of the path in which the funnels lie, as will be further described.

Each of the funnels in the first set of funnels 13, for example, also include an inlet, such as at 31 (FIG. 1A), and an outlet, such as at 32. The inlet 31 of the funnel is located in the top surface 33 of the wheel 12, while the outlet 32 of each of the funnels of the first set are defined in an undersurface or lower surface 34. The inlets of the funnels in the first set 13, that is funnels 14–19, are all disposed and oriented in a circular path on a radius R1, from the center line or axis of rotation 36 of the wheel 12. This circular path is shown in FIG. 1 at 38 and is defined by a radius R1 from the axis.

Each of the funnels 21–25 of the second set of funnels 20 also has an inlet or opening defined at 40 and an outlet 41 defined by the underside 34 of the wheel 12. The outlets 32 of the first set of funnels and the outlets 41 of the second set of funnels are oriented to discharge into the filler spouts as will be described.

Moreover, it will be appreciated that the openings 40 of the second set 20 of funnels lie in a circular path 43 which lies on a radius R2 extending from the axis rotation 36 of the wheel 12. It will thus be appreciated that the radius R1 is less than that of R2, so that the second set of funnels lies concentrically with and outside the first or interior set of funnels.

It will be appreciated that the funnels themselves are created within the wheel 12 by any suitable technique, such as machining, molding, casting, or any other technique suitable in the industry. It will also be appreciated that wheel 12 may be solid, as shown, spoked, or in some other configuration supporting or defining the funnels as described herein.

Continuing with the description of the wheel 12, it will be appreciated that product channels are defined on the top surface 33 of the wheel 12. These channels, for example, can be defined by the channel dividers or walls 45, 46 and 47, as shown in FIG. 2 and FIG. 1. The channels thus also lie generally on the respective radiuses R1 and R2 with the channel, such as channel 48, comprising a first channel lying between the walls or dividers 45 and 46 and the second channel 49 lying between the walls or dividers 46 and 47.

Finally, it will be noted that the funnels of the first set are offset from funnels of the second set by about ½ pitch. Funnels alternately could be evenly indexed or could be otherwise offset for a desired operation. Also, the spouts to be described could be changed to communicate with other funnels or produce other alternative effects as will be described. For example the funnels could be configured to drop two similar products into two adjacent pouches then a different item or flavor into a third pouch, for example, and so on, where desired.

A plurality of spouts 50 are attached to the underside or lower surface 34 of the wheel 12 by any suitable means. In the past, it has been found preferable to secure the spouts by means of flanges on the spouts and springloaded screws, bolts or other fasteners or any other suitable means, not part of the invention, which will hold the spouts substantially up against the underneath surface 34 of the wheel 12.

Any suitable means may be utilized to mount the spouts on the wheel 12, however, and the mounting devices are not shown, as they constitute no part of the present invention other than to merely hold the spouts onto the undersurface of the wheel. One of such hold down units is shown diagrammatically on the upper right side of FIGS. 1 and 4.

Figure 2A:
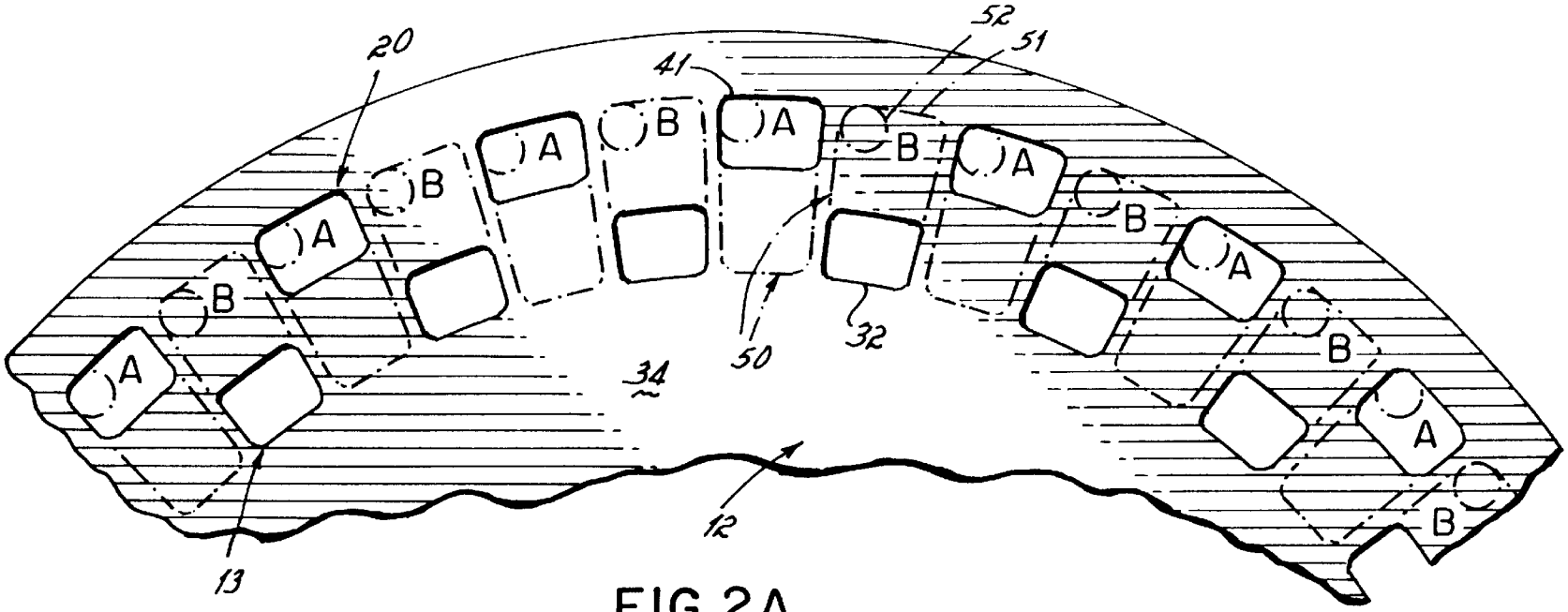
FIG. 2A is a bottom view of the wheel of the invention taken along lines 2A—2A of FIG. 2.
Figure 3:
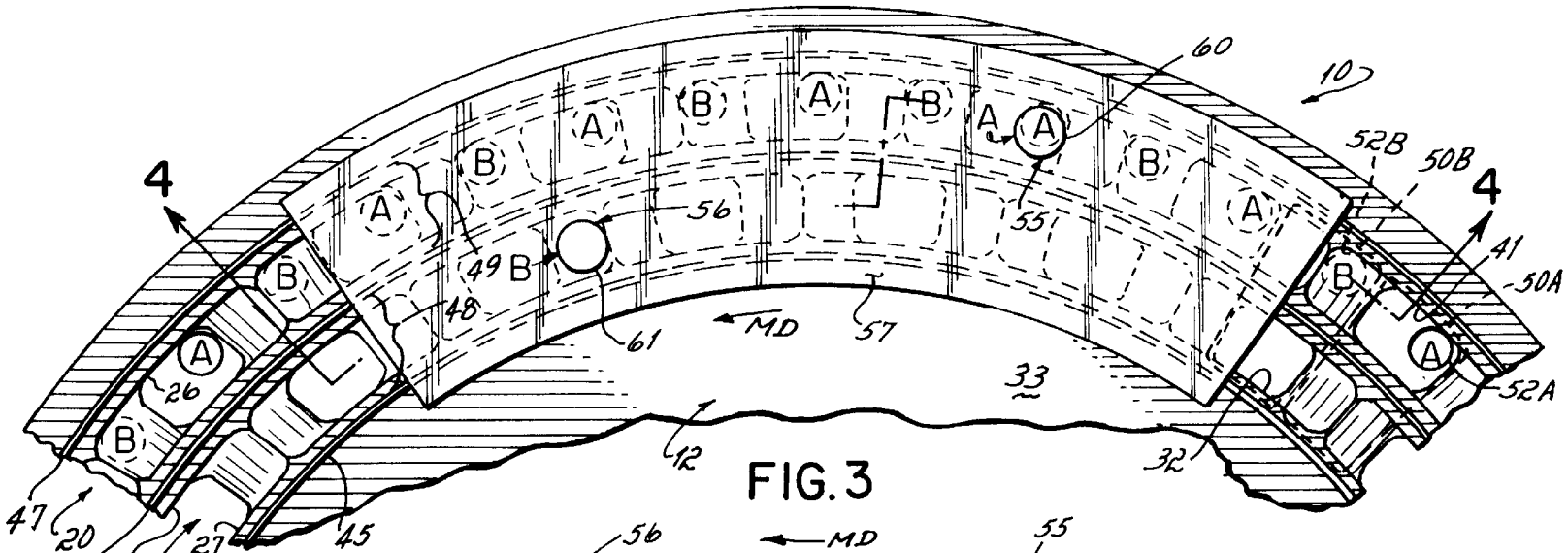
FIG. 3 is a top plan view of a portion of the wheel of the invention and stay product feeder.

The orientation of the spouts with respect to the wheel and the first and second sets of funnels is perhaps best seen in FIG. 2A and in FIG. 3. FIG. 2A is a view of the bottom of the wheel 12, showing the bottom surface 34 with the respective funnel outlets shown therein. The funnel outlets 32 in the first set of funnels 13 are shown in the wheel 12 interiorly of the outlets 41 of the second set of funnels 20, all as best seen in FIG. 2A.

The positions of the spouts 50, but not the spouts themselves, are shown in dotted lines in FIG. 2A, since the figure is taken along generally the surface 34 of the wheel 12. Each of the spouts 50 includes an inlet 51 and a discharge outlet 52, the positions of which are shown in phantom.

Thus, it will be seen as illustrated in FIG. 2A that each of the inlets 51 of each of the spouts is large enough to encompass both the outlet 32 of the first set 13 of funnels and alternately, the outlets 41 of the second set 20 of the funnels. But since the outlets 32, 41 of the funnels alternate, only one alternating funnel feeds into each spout 50.

It will also be appreciated by looking at FIG. 2A that one spout is associated with each funnel, thus alternating spouts 50 correspond and are in operative communication with the outlets 32 of the first set of funnels 13, while alternate spouts are in operative communication with the outlets 41 of the second set of funnels 20.

This is further illustrated, for example, by noting that, as used in these drawings, a first product (letter "A") will be handled in the second channel 49 and by the second set of funnels 20. This product is diagrammatically associated with the letter A in FIG. 1, while a second product (letter "B") is diagrammatically associated with the letter B and is handled by the funnels of the first set 13.

Accordingly, alternating spouts 50 are utilized to handle the first product, dropping them into alternative pouches as illustrated by the letters on the diagrammatic pouch chain, while a second group of alternating funnels are adapted to communicate operatively with the first set of funnels 13 to transfer the second product, associated with the letter B, into those spouts and into alternate pouches in the train as illustrated in FIG. 1. The spouts feed product from their discharge outlets 52 directly into the open mouths of the pouches in a filling station as shown in the lefthand side of FIG. 2.

Turning now to FIG. 3, which is a top plan view looking down on the filler wheel 12 generally in the area of the product feeders, which will be described, and to FIG. 4, these illustrate the nature and relation of the first set 13 and second set 20 funnels to each other and to the spouts 50 therebeneath, which are again shown in dotted lines in FIG. 3, and solid lines in FIG. 4.

Figure 4:
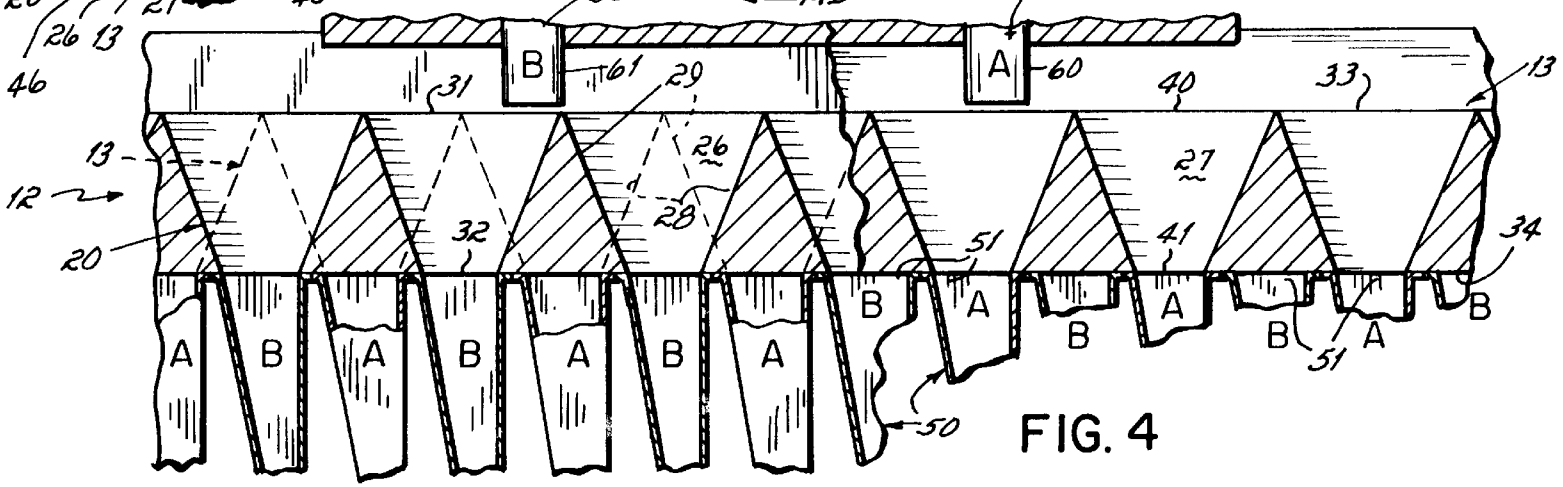
FIG. 4 is a cross-sectional view taken along lines 4—4 of FIG. 3.

The funnels of the second set 20 each have leading edges or surfaces 29 and trailing edges or surfaces 28, as shown in FIG. 4. The funnels also have an outlet at 41, as shown in FIG. 4.

An underlying spout shown in dotted lines is shown at 50A at the righthand side of FIG. 3. This spout has an outlet 52A, and it will be appreciated that the spout 50A underlies the outlet 41 of this particular funnel in the second set of funnels. Accordingly, material which resides in the channel 49 and referred to the material "A" will flow from the outlet 41 of the funnel in the second set 20 of funnels, into a spout such as spout 50A and out the discharge outlet 52A of that spout, and to an underlying pouch, such as any of the pouches labeled "A" in FIG. 1.

Likewise, the funnels of the second set 13 each have a leading edge or surface 29 and a trailing edge or surface 28, together with an outlet 32. Also as shown in FIG. 3 a funnel 50B underlies the outlet 32 of the funnel in the first set 13. The spout 50B has a discharge outlet 52B which is shown in dotted lines from above wheel 12. Accordingly, material such as material associated with the letter "B" flows through the funnels of the first set 13 and outwardly of their outlets 32 into underlying spouts such as spouts 52B and thereafter to the outlet 52B, where it is deposited into a pouch, such as labeled "B" in FIG. 1.

In order to deposit product onto the wheel 12, many suitable devices can be utilized. Shown diagrammatically in FIG. 1 are auger feeders 55, 56. These feeders each include a cover, such as at 57, extending over portions of the channels 48, 49. Material associated with the letter "A", is augered through a feed tube 60, for example, and is deposited into the second channel 49, while material associated with the letter "B" is augered through a feed tube 61 and is deposited into the first channel 48.

The material is fed by the augers into these feeding devices at a constant rate. Since the wheel 12 moves at a constant velocity, and since the time it takes for each of the funnel inlets, whether it is inlet 40 or inlet 31, to pass the feed area is constant, a precisely measured and metered amount of product is deposited into each of the funnels, which then of course transfers and drops the material into an associated spout 50 and thereafter that material is inserted into the pouches of the train 11.

To this end, of course, it is preferable to cant or tilt the wheel 12 as shown in FIG. 2 so that, for example, on the left hand side of the figure, the spouts 50 are declined into the open mouths of the pouch in the pouch train 11.

On the other side of the drawing, it will be appreciated that the spouts 50 are lifted upwardly out of the mouths of the pouches in the train 11 (see also FIG. 1), so that those pouches can be removed from the pouch supporting wheel 63 and thereafter sealed, cut and packaged.

The grippers and supporting wheel structure 63 for the pouches comprise no part of the present invention and can be seen in numerous patents that are well known in the art. See, for example, U.S. Pat. Nos. 3,821,873 and 4,232,504, and the other patents cited above, each expressly incorporated herein by reference and showing a variety of pouch supporting apparatus.

It will be appreciated from the drawings that the leading and trailing surfaces of the various funnels in the different sets 13, 20 essentially meet along lines at which the respective funnels in each set are respectively adjacent, following one another.

Several other features of the invention are thus, from this description and drawings, readily appreciated. For example, the funnels themselves of both sets of funnels are formed wholly within the relatively thin thickness of the wheel 12. Material deposited on one of the first or second channels only has to fall through the relatively thin thickness of the wheel 12, then into the spouts 50 and then into the pouches into which the spouts are inserted. This distance from the top surface of wheel 12 to the discharge opening of spouts 50 is preferably on the order of nine to ten inches.

When compared to prior multiple product feeders wherein the funnels themselves are separate units and are mounted on separate plates above and distinctively to the spout plates, there is a much greater vertical distance through which the product must fall, for example, on the order of about nineteen inches or more.

Accordingly, since the product has to fall less distance in the invention described herein, the time it takes for the product to fall that distance is substantially decreased and the speeds attainable with a filler wheel for similar product flow rates can be substantially increased. Thus, the potential speed of the filler wheel is increased and, to the extent that it exceeds the speeds permitted by other components of the pouching operation, it no longer constitutes an obstruction to an increase in those speeds.

Accordingly, speeds of pouch filling, for example, are moved upwardly significantly from the range of 900 pouches per minute to the range of about 1100 pouches per minute, all as a result of the invention which contemplates a single level filling wheel, that is where all of the material handling from the feeder into the pouch is handled with a single level wheel, as compared to a dual level structure of the prior art.

Several other items will be appreciated from the drawings. First, it will be appreciated that the outlets 52 of the spouts 50 are all preferably mounted within the same circular path and rotate on the same radius for each spout.

On the other hand, it will be appreciated that the outlets 32 and 41 of the funnels in the respective sets 13, 20 do not rotate in the same circular path and are not mounted on the same radial distances from the center line or axis of rotation 36.

The difference in the radial position of the respective outlets of the funnels of the two different sets is accommodated by the width of the spouts 50 at the inlet end of those spouts and in a radial direction with respect to wheel 12. Each spout, being associated only with one funnel, nevertheless extending over the entire width of the two different circular paths traversed by the respective sets of funnels.

It will also be appreciated that the product paths or channels 48, 49 can be defined on, or in, or with respect to, the wheel 12 and particularly the upper surface thereof. It is possible to machine the paths into the surface where they would be also partially defined by the mouths of the funnels, or to simply divide or define the paths by means of the upstanding dividers or walls 45, 46 and 47 as shown.

It will further be appreciated that the structure of the wheel 12 could be changed to constitute a spoked wheel, for example, or some other structure simply holding or defining funnels within the thickness of the wheel 12, but with it being understood that the spouts 50 are all mounted to that same structure which are forming the wheel. Accordingly, the funnels of each set 13 and 20 are described as being integrally formed within the wheel 12.

It will be appreciated that the volume of product deposited in any of the pouches is a function of the constant product feed rate and of the wheel speed, given the particular construction of the funnels. It is therefore possible to increase or decrease product volume by slowing or speeding up the wheel 12 or by increasing or decreasing the product feed rate. Any change in the speed of the wheel 12, for example, is accommodated by the corresponding change in the velocity of the pouch train 11.

The filler wheel of the invention can also be beneficial in increasing speed of packaging a single product in pouches where plugging the bottom of the pouch filling spout may be critical.

The pouch spout discharge area is critical to the amount of product that can be fed through a spout without plugging. The size of the spout opening is limited by the size of the pouch opening with a working clearance between the sides of the pouch and outside of the spout opening. If the product is dumped into the spout all at once, there is a greater tendency to plug small spout openings than if the product flow is spread out, such as over two or more stations. With a two channel filler wheel such as described herein, the feed time for product of a single pouch is spread out over a time period of two stations instead of one. The same is true with three stations instead of one on a three row filler wheel.

By stringing out the product in the spout over a longer period of time, there is less tendency for the spout to plug, allowing operation for single products at a higher speed. This could be accomplished by feeding the same product in each of the radial channels, i.e. through each of the augers.

These and other modifications and advantages will become readily apparent to those of ordinary skill in the art without departing from the scope of the invention, and applicant intends to be bound only by the claims appended hereto.

What is claimed is:

1. A product filler for filling product pouches and comprising:

a single wheel having a circumferential portion of predetermined thickness, said wheel having upper and lower surfaces and an axis of rotation;

at least two sets of product funnels defined in said wheel, said funnels having respective inlets proximate said upper surface and respective outlets proximate said lower surface;

a first set of funnels being oriented in a circular path around said wheel;

a second set of funnels being oriented in a circular path in said wheel outside said first set;

a plurality of spouts mounted on and depending from said lower surface of said wheel, each spout having an inlet in operative communication with one of said outlets of said funnels and a discharge outlet oriented in a circular path below said wheel, at least two product channels oriented on the upper surface of said wheel proximate said circumferential portion, a first channel being disposed about a first circular path at least partially defined by said inlets of said funnels of said first set and in operative product transfer relation therewith, and a second channel being disposed about a second circular path at least partially defined by said inlets of said funnels of said second set, a feeder for providing a product to each of said channels;

wherein a product is fed into each channel and from there drops into a respective set of funnels and spouts for alternative feeding from the discharge openings of respective alternate spouts;

wherein pouches are conveyed through a pouch filling station; and said discharge openings of said spouts are moved into operative position for feeding product directly from said spouts into said pouches at said filling stations.

2. A filler as in claim 1 wherein the product fed into one channel is different from the product fed into another channel and wherein successive spouts receive and transfer the two different products therethrough.

3. A filler as in claim 2 wherein said spout discharge openings are each disposed on the same circular path.

4. A filler as in claim 3 wherein said funnel discharge openings of the funnels of one set are in one circular path and the funnel discharge openings of another set are in a different circular path.

5. A filler as in claim 1 wherein product drops in a vertical direction through said funnels and spouts and wherein the vertical drop of product from the upper surface of said wheel to the spout discharge outlets is less than about ten inches.

6. A filler as in claim 1 wherein said wheel is tilted from the horizontal and spouts depending therefrom are oriented in a path intersecting a horizontal plane defined by the mouths of empty pouches to be filled.

7. A filler as in claim 2 wherein each product is fed through an auger feeding product continuously to a product dedicated channel.

8. A filler as in claim 4 wherein the spouts are identical and the spout inlets are coextensive transversely with each of said funnel discharge openings.

9. A filler as in claim 1 wherein the first set of funnels is offset about one half of the pitch of the second set of funnels, and each funnel is tapered inwardly in a downward direction.

10. A filler as in claim 9 wherein the spouts are each tapered outwardly from said axis of rotation of said wheel.

11. A multiple flavor product filler wheel having upper and lower surfaces for filling open-mouthed pouches moving in a path and comprising:

at least first and second respective sets of funnels defined in said wheel, the outlets of one set of funnels being disposed radially outward of the outlets of another set of funnels, a plurality of spouts mounted on a lower surface of said wheel, each alternate spout being in operative communication with one respective funnel outlet of said first set of funnels and each other alternate spout being in operative communication with a funnel outlet of a second set of funnels, said spouts having outlets mounted to move in a path corresponding with a path of said open-mouthed pouches and feeding product directly into said pouches.

12. A feeder as in claim 11 including at least two channels circularly disposed on said wheel, one operatively communicating with inlets of said first set of funnels and another channel operably communicating with inlets of said second set of funnels.

13. A product filler wheel for feeding product into a series of open-mouthed pouches moving in a path and comprising:

a single filler wheel having a circumferential area of predetermined thickness and having an upper and lower surface;

at least two product dispensers for feeding two different products to two discrete channels disposed around the upper surface of said filler wheel, each channel being defined by a respective set of funnels defined in said filler wheel and having inlets communicating with a respective channel;

a plurality of spouts disposed on said lower surface of said wheel, each spout serving as a conduit for receiving product from one or the other of said funnels in said filler wheel and for transferring product therefrom for filling pouches, said spouts having discharge outlets mounted to move in a path operatively communicating with said path of said open-mounthed pouches and feeding product directly into said pouches.

14. A single level multiple product filler wheel for filling product into the open mouths of pouches moving in a path therebeneath, comprising:

a single filler wheel means for receiving at least two separate products and for transferring said two product through respective sets of product funnels defined in said wheel means, one funnel set for each product and delivering said products through said respective funnel sets to alternating spouts attached to a lower surface of said wheel means for delivery to a pouch;

said spouts having discharge outlets movable in a path intersecting said pouch path and directly delivering product to said pouches.

15. A filler wheel as in claim 14 further in combination with a pouch filling machine, said spouts aligning operatively with a chain of respective pouches for filling pouches sequentially with separate products.

16. A filler wheel as in claim 14 wherein the discharge outlets of said spouts are all oriented in the same circular path.

17. A filler wheel as in claim 16 wherein said funnels have discharge openings, the openings of one funnel set residing in a first circular path and the openings of another funnel set residing in a second circular path, concentric with said first path.

18. Apparatus for filling pouches and comprising:

a pouch wheel for holding a portion of a train of open top pouches in a circular path for filling;

a filler wheel having an upper surface and a lower surface;

at least two product channels defined at an upper surface of said filler wheel, both channels lying in two respective circular paths, one inside the other, at least two sets of funnels defined in said filler wheel, one set having funnel with openings lying under one of said circular paths and another set of funnels having funnels with openings lying under the other of said circular paths;

the funnels of each set of funnels having outlets;

discharge spouts mounted on the lower surface of said filler wheel and having inlets and discharge outlets, with at least some of the discharge outlets disposed above said circular path of said open top pouches at least some of said discharge spouts having said outlets above said path intersecting said circular path of said open top pouches;

respective inlets of said spouts alternately disposed in operative communication with respective outlets of the funnels of said funnel sets;

a first product feeder for feeding a first product to a first one of said channels;

a second product feeder for feeding a second product to a second one of said channels; and wherein a first product in said first channel feeds into funnels of a first set and a second product from a second channel into funnels of a second set, such that the two products are fed alternately from respective funnels into said spouts and from said spout discharge outlets directly into pouches one after the other.

19. In a multiple product filling apparatus of the type having at least two sets of product funnels, one set for each product for filling a plurality of open-mouthed pouches moving in a path;

a plurality of spouts for alternatively receiving products from funnels of each funnel set, and a feeder for supplying a product to each funnel set, the improvement wherein said funnels are defined integrally within a wheel having an underside to which the plurality of spouts is attached, thereby providing a single level filler wheel for alternately dispensing multiple products, and wherein said spouts have discharge outlets movable in a path with at least a portion of said spout discharge outlets being inserted within open-mouthed pouches and directly delivering product thereto.

20. A method of feeding multiple products to alternate succeeding pouches, including the steps of:

feeding at least two products into respective feed paths on a wheel;

dropping the products respectively into two sets of funnels defined within the wheel;

transferring product from each set of funnels into alternating spouts;

aligning the spouts with respective pouches and inserting portions of said spouts directly into pouches; and dropping products from said spouts directly into respective alternate pouches into which said spouts are inserted.

21. A method of loading pouches including the steps of:

feeding product into at least two product feed paths defined on a filler wheel;

dropping product from one feed path directly into a first set of funnels defined within said wheel;

dropping product from another feed path directly into a second set of funnels, defined within said wheel;

dropping product from each set of funnels directly into alternating pouch filler spouts mounted on an underside of said wheel;

aligning outlets of said spouts with respective pouches; inserting portions of said spouts into said pouches; and dropping product from said alternating pouch filler spouts directly into alternating pouches, one after the other.

22. A single level, multiple product filler apparatus for filling open-mouthed pouches moving in a path and comprising:

a single wheel of predetermined circumferential thickness having upper and lower surfaces, defining a single level, a first set of funnels disposed in a first circular path within said single wheel between said surfaces at said single level;

a second set of funnels disposed in a second circular path within said single wheel between said surfaces at said single level;

a plurality of spouts mounted on a lower surface of said single wheel beneath said funnels in said single level and having spout discharge outlets;

said spout outlets being mounted for motion in a path which at least partially intersects the path of said pouches; and said funnel and said spouts defining an uninterrupted flow path for product through said funnels and said spout discharge outlets directly into said pouches.

23. Apparatus as in claim 22, wherein said flow path is fully enclosed.

24. Apparatus as in claim 22 wherein said funnels comprise recesses in said wheel between said upper and lower surfaces.

25. Apparatus as in claim 22 wherein said funnels of said first set have outlets in one circular path in said lower surface of said wheel and said second set having outlets in a second, different circular path in said lower surfaces of said wheel.

26. A single level multiple product filler apparatus for filling pouches moving in a path and said apparatus comprising:

a single wheel having an upper surface and a lower surface;

a first set of funnels formed within said wheel;

a second set of funnels formed within said wheel;

said funnels having entry openings defined in the upper surface of said wheel and outlet openings formed in a lower surface of said wheel;

filling spouts attached to said lower surface of said wheel;

said filling spouts having discharge outlets moving in a path at least partially intersecting the path of said pouches.

27. Apparatus as in claim 26, said funnels and said spouts comprising a fully enclosed product path from said funnels through said spouts directly into said pouches.

28. Apparatus as in claim 26 wherein said funnel outlet openings of said first set of funnels are disposed on one circular path around said lower surface of said wheel and said funnel;

outlet openings of said second set of funnels being disposed in a different circular path around said lower surface of said wheel.

29. Apparatus as in claim 28 wherein said filling spouts have outlets all disposed in a same circular path with each other.

30. Apparatus as in claim 26 wherein said entry openings of said first set of funnels are disposed in one circular path on said upper surface of said wheel and said entry openings of said second set of funnels are disposed in a different circular path on said upper surface of said wheel.

31. A single level multiple product filler wheel apparatus having upper and lower surfaces for filling pouches moving in a path therebetween and comprising:

a first set of funnels in said wheel;

a second set of funnels in said wheel said funnels having outlets in a lower surface of said wheel; and filler spouts attached to said lower surface of said wheel beneath said funnel outlets, said filler spouts having product discharge outlets disposed about a path which at least partially intersects said pouch path for delivering product directly to pouches in said pouch path.

32. A wheel as in claim 31 wherein said funnels and spouts define respective enclosed product paths through said funnels and spouts directly into said pouches.

33. A wheel as in claim 31 wherein said outlets of said first set of funnels lie in a circular path and said outlets of said second set of funnels lie in a different circular path.

34. A wheel as in claim 33 wherein said spouts have outlets, each of which lie in a common circular path with each other.

* * * * *